US007527531B2

(12) United States Patent
Lin

(10) Patent No.: US 7,527,531 B2
(45) Date of Patent: May 5, 2009

(54) VEHICULAR LIGHT EMITTING DIODE CONNECTOR

(76) Inventor: Yu-Chu Lin, No. 477, Chung Shan N. Rd., Yung Kang City, Tainan Hsien (TW)

( * ) Notice: Subject to any disclaimer, the term of this patent is extended or adjusted under 35 U.S.C. 154(b) by 461 days.

(21) Appl. No.: 11/538,795

(22) Filed: Oct. 4, 2006

(65) Prior Publication Data

US 2008/0085635 A1 Apr. 10, 2008

(51) Int. Cl.
*H01R 24/00* (2006.01)

(52) U.S. Cl. ..... 439/699.2; 439/56; 439/619; 439/918

(58) Field of Classification Search ..... 439/56, 439/611, 617, 619, 699.1, 699.2, 918; 362/546, 362/548, 549
See application file for complete search history.

(56) References Cited

U.S. PATENT DOCUMENTS 5,501,618 A * 3/1996 Muta et al. ..... 439/699.2
6,666,689 B1 * 12/2003 Savage, Jr. ..... 439/56
6,878,015 B2 * 4/2005 Fan ..... 439/699.2
7,306,488 B2 * 12/2007 Krijne et al. ..... 439/617
7,322,828 B1 * 1/2008 Chiang et al. ..... 439/56
7,387,544 B1 * 6/2008 Hsu ..... 439/699.2
2003/0232540 A1 * 12/2003 Nick et al. ..... 439/617
2008/0085635 A1 * 4/2008 Lin ..... 439/619

* cited by examiner

*Primary Examiner*—James Harvey
(74) *Attorney, Agent, or Firm*—WPAT, P.C.; Anthony King

(57) ABSTRACT

A vehicular light emitting diode connector includes an outer case, an inner case, a first signal wire, and a second signal wire. The outer case comprises an open end and a compartment. The inner case is inserted into the compartment of the outer case and has a through hole therein to form a first open end and a second open end. The first signal wire is secured to the inner wall of the first open end of the inner case, and the second signal wire is secured to the outer case.

3 Claims, 4 Drawing Sheets

VEHICULAR LIGHT EMITTING DIODE CONNECTOR

BACKGROUND OF THE INVENTION

1. Field of the Invention

The present invention relates to a vehicular light emitting diode connector, and more particularly to a connector having an outer case provided with grasp sections and an inner case provided with protuberances. The inner case is inserted and secured in a compartment of the outer case for connection of light emitting diodes and a vehicular light.

2. Description of the Prior Art

There are many vehicular lighting systems on the market, in particular to a newly invented LED lighting which provides a bright light and consumes less power.

However, each light emitting diode has a unique design and is not compatible with a traditional vehicular light.

SUMMARY OF THE INVENTION

It is the primary object of the present invention to provide a vehicular light emitting diode connector, which is compatible with a traditional vehicular light.

It is another object of the present invention to provide a vehicular light emitting diode connector, which uses a special design to isolate the wires from tangling with each other for safety and for maintenance purposes.

It is a further object of the present invention to provide a vehicular light emitting diode connector, which provides grasp sections for the user to hold the connector firmly and to facilitate maintenance.

According to the present invention, there is provided a vehicular light emitting diode connector, comprising:

an outer case comprising an open end, an insertion section, and a compartment interconnecting with said open end and said insertion section, a pair of slots being formed along the circumference of said outer case with a pair of grasp sections extending from said slots outwardly;

an inner case inserted into said compartment of said outer case comprising a through hole to form a first open end and a second open end, an outer wall of said second open end being disposed with a pair of protuberances;

a first signal wire connected to an inner wall of said first open end of said inner case; and a second signal wire being connected to said insertion section of said outer case and comprising a contact point at one end to be in contact with said insertion section.

Preferably said outer case comprises at least one insertion section thereof.

Preferably said insertion section of said outer case comprises ribs thereof.

DETAILED DESCRIPTION OF THE PREFERRED EMBODIMENTS

Figure 1:
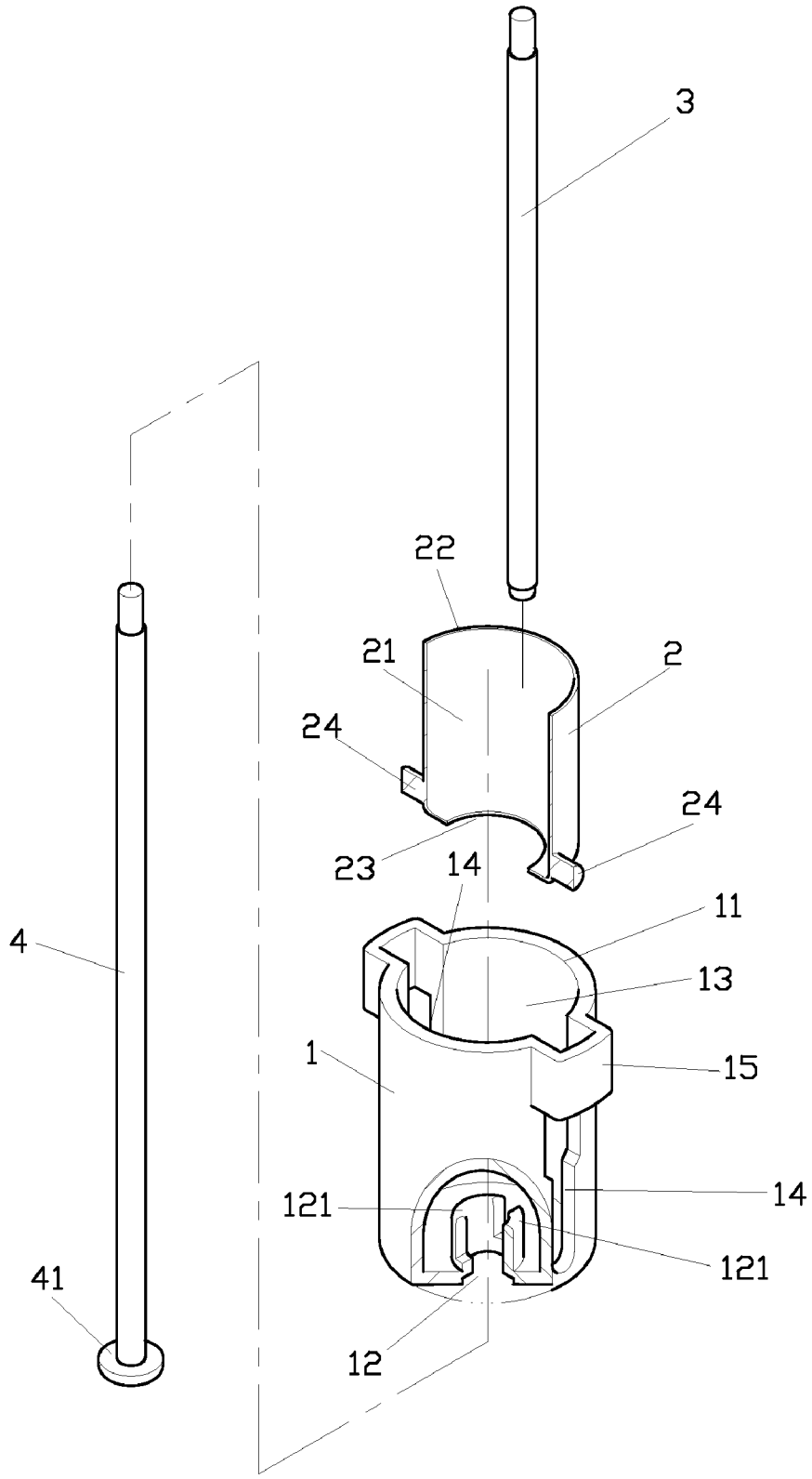
FIG. 1 is an exploded view of a first embodiment of the present invention.

As shown in FIG. 1, a first embodiment of the present invention comprises an outer case 1, an inner case 2, a first signal wire 3, and a second signal wire 4.

The outer case 1 comprises an open end 11, an insertion section 12, and a compartment 13. The insertion section 12 is disposed with a pair of corresponding ribs 121 therein. The compartment 13 interconnects with the open end 11 and the insertion section 12. A pair of slots 14 is longitudinally formed along the circumference of the outer case 1 with a pair of grasp sections 15 extending from the slots 14 outwardly.

The inner case 2 is inserted into the compartment 13 of the outer case 1 through the open end 11. The inner case 2 comprises a through hole 21 therein to form a first open end 22 at one end and a second open end 23 at the other end. The outer wall of the second open end 23 is formed with a pair of protuberances 24. The protuberances 24 are in an equal height and correspond to each other to function as locating elements for the inner case 2 in the outer case 1.

The first signal wire 3 is a negative electricity source, and is connected and secured to the inner wall of the first open end 22.

The second signal wire 4 comprises a contact point 41 at one end, and is a positive electricity source. The contact point 41 of the second signal wire 4 is connected to the insertion section 12.

Figure 2:
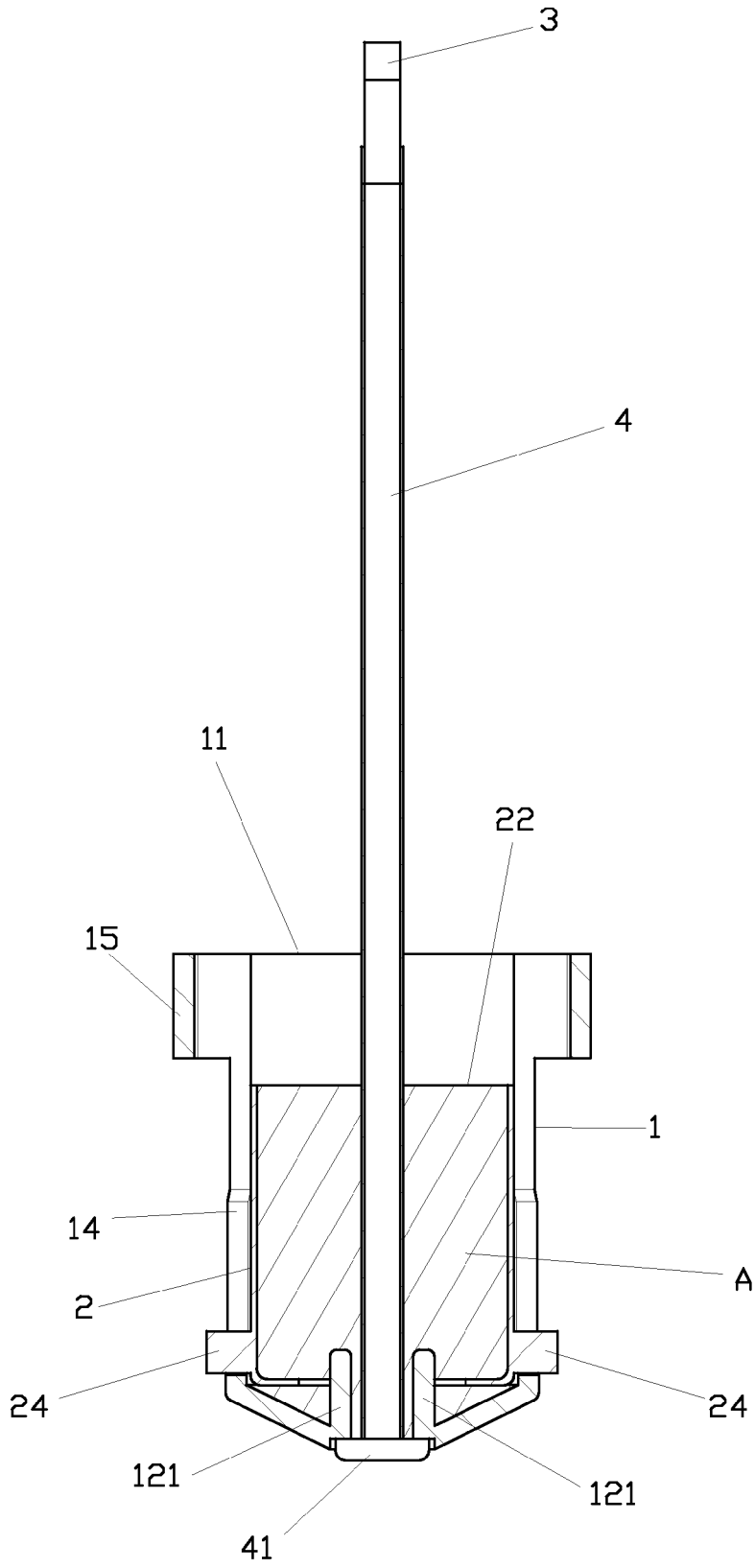
FIG. 2 is a side cross-sectional view of the first embodiment of the present invention.

To assemble the present invention, as shown in FIGS. 1 and 2, the inner case 2 is inserted into the outer case 1 through the open end 11. The two protuberances 24 at the second open end 23 slide along the two slots 14 to facilitate sliding process and to maintain a secure status. The second open end 23 of the inner case 2 is located on the insertion section 12 of the outer case 1. The first signal wire 3 is secured to the inner wall of the first open end 22 to transmit negative electricity to the inner case 2. The second signal wire 4 is inserted into the outer case 1 through the insertion section 12 into the first open end 22 with the contact point 41 engaging with the insertion section 12 of the outer case 1 to transmit positive electricity. The outer case 1 is later filled with filler A to isolate the second signal wire 4 from the first signal wire 3 and to protect the two signal wires from tangling. This design is applicable to connect a light emitting diode and a traditional lighting system. The grasp sections 15 are formed to have an included angle that is easy for the user to hold the connector firmly and to facilitate maintenance.

Figure 3:
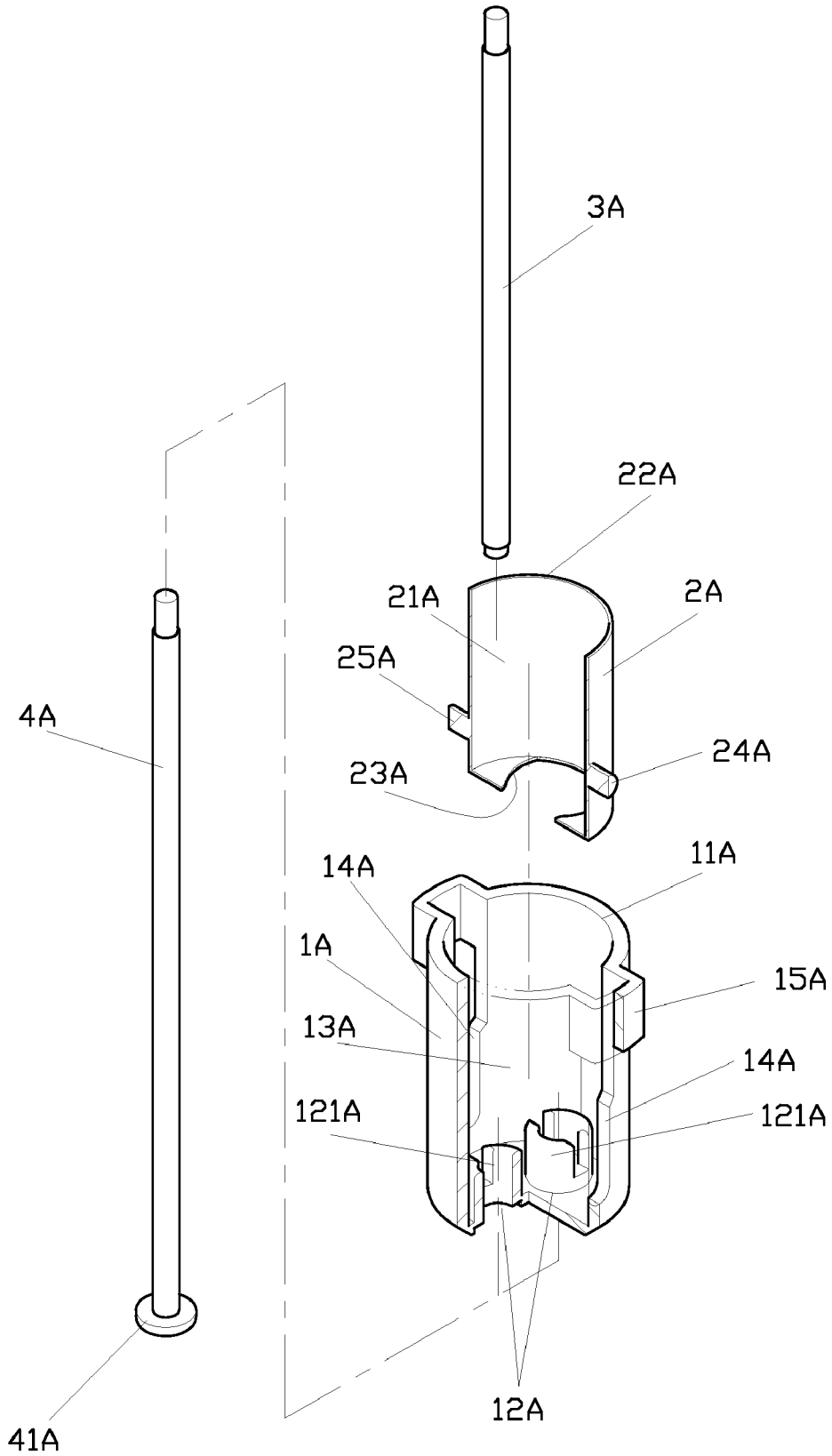
FIG. 3 is an exploded view of a second embodiment of the present invention.

FIG. 3 shows a second embodiment of the present invention, which comprises an outer case 1A, an inner case 2A, a first signal wire 3A and second signal wires 4A.

The outer case 1A comprises an open end 11A, a number of insertion sections 12A, and a compartment 13A. Each insertion section 12A is disposed with a pair of corresponding ribs 121A therein. The compartment 13A interconnects with the open end 11A and the insertion sections 12A. A pair of slots 14A is longitudinally formed along the circumference of the outer case 1 with a pair of grasp sections 15A extending from the slots 14 outwardly.

The inner case 2A is inserted into the compartment 13A of the outer case 1A through the open end 11A, and comprises a through hole 21A therein to form a first open end 22A at one end and a second open end 23A at the other end. The outer wall of the second open end 23A is formed with a pair of protuberances 24A and 25A. The protuberances 24A and 25A are in an unequal height and correspond to each other to function as locating elements for the inner case 2A in the outer case 1A.

The first signal wire 3A is a negative electricity source, and is connected and secured to the inner wall of the first open end 22A.

Each of the second signal wires 4A comprises a contact point 41A at one end, and is a positive electricity source. The contact point 41A of each second signal wire 4A is connected to a relative insertion section 12A.

Figure 4:
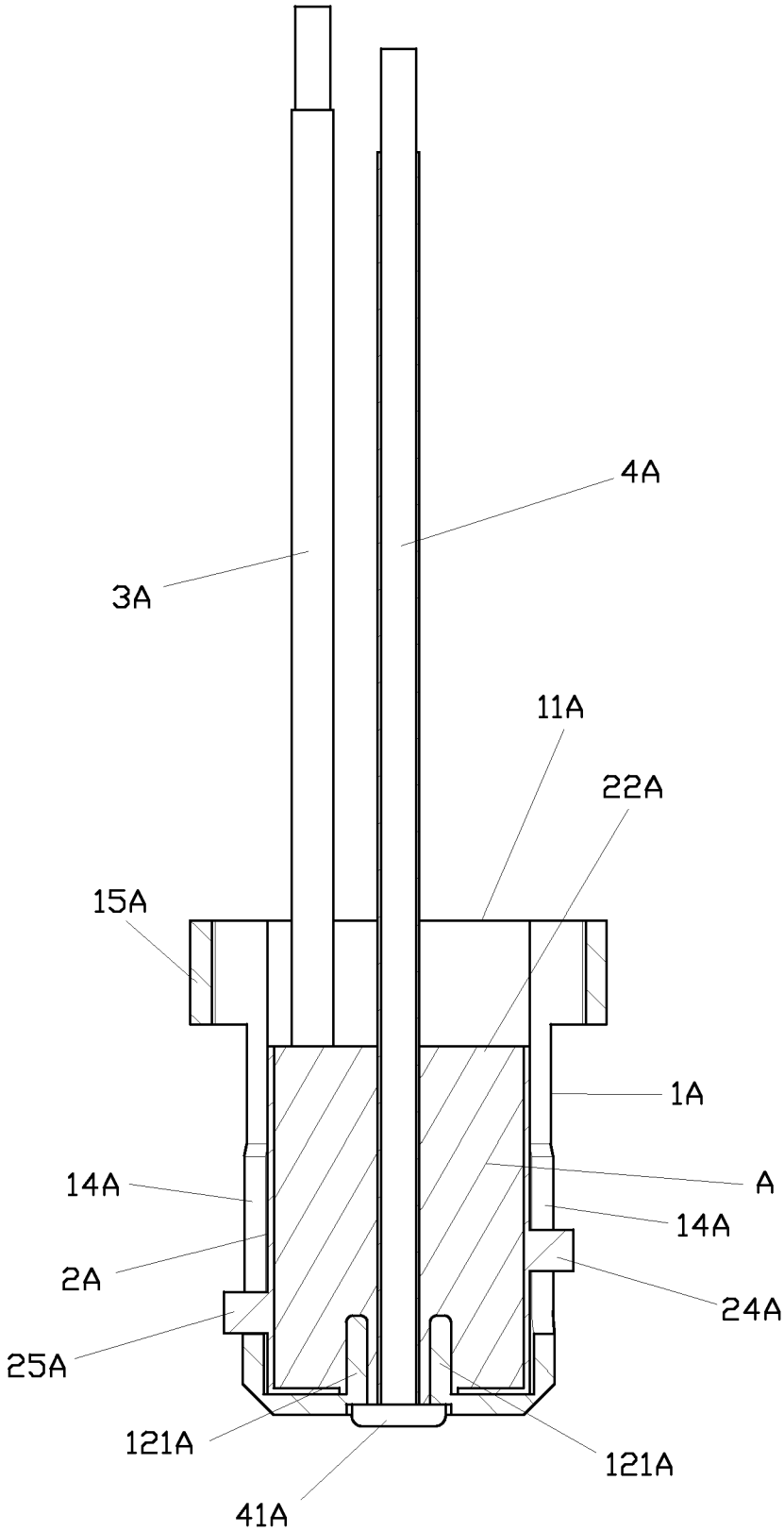
FIG. 4 is a side cross-sectional view of the second embodiment of the present invention.

To assemble the present invention, as shown in FIGS. 3 and 4, the inner case 2A is inserted into the outer case 1A through the open end 11A. The two protuberances 24A and 25A slide along the two slots 14A to facilitate sliding process and to maintain a secure and steady status. The first signal wire 3A is secured to the inner wall of the first open end 22A to transmit negative electricity to the inner case 2A. Each of the second signal wires 4A is inserted into the outer case 1A through the insertion section 12A into the first open end 22A with the contact point 41A engaging with the insertion section 12A of the outer case 1A to transmit positive electricity. The outer case 1A is later filled with filler A to isolate the second signal wire 4A from the first signal wire 3A and to protect the signal wires from tangling. This design is applicable to connect light emitting diodes and a traditional lighting system. The grasp sections 15A are formed to have an included angle that is easy for the user to hold the connector firmly and to facilitate maintenance.

What is claimed is:

1. A vehicular light emitting diode connector, comprising:

an outer case comprising an open end, an insertion section, and a compartment interconnecting with said open end and said insertion section, a pair of slots being formed along the circumference of said outer case with a pair of grasp sections extending from said slots outwardly;

an inner case inserted into said compartment of said outer case comprising a through hole to form a first open end and a second open end, an outer wall of said second open end being disposed with a pair of protuberances;

a first signal wire connected to an inner wall of said first open end of said inner case; and a second signal wire being connected to said insertion section of said outer case and comprising a contact point at one end to be in contact with said insertion section.

2. The vehicular light emitting diode connector, as recited in claim 1, wherein said outer case comprises a plurality of insertion sections.

3. The vehicular light emitting diode connector, as recited in claim 2, wherein said insertion section of said outer case comprises ribs thereof.

* * * * *